United States Patent [19]

Rinaldi

[11] Patent Number: 4,544,041

[45] Date of Patent: Oct. 1, 1985

[54] WELL CASING INSERTING AND WELL BORE DRILLING METHOD AND MEANS

[76] Inventor: Roger E. Rinaldi, 8435 S. Quebec, Tulsa, Okla. 74137

[21] Appl. No.: 545,222

[22] Filed: Oct. 25, 1983

[51] Int. Cl.[4] ..... E21B 7/20

[52] U.S. Cl. ..... 175/57; 175/104; 175/171; 175/203

[58] Field of Search ..... 175/57, 92, 104, 162, 175/171, 203, 257

[56] References Cited

U.S. PATENT DOCUMENTS

| | | | |
|---|---|---|---|
| 2,588,068 | 3/1952 | Williams et al. | 175/171 |
| 2,784,942 | 3/1957 | Peck et al. | 175/171 |
| 3,117,636 | 1/1964 | Wilcox et al. | 175/171 |
| 3,169,592 | 2/1965 | Kammerer | 175/257 |
| 3,369,618 | 2/1968 | Moore | 175/104 |
| 3,389,758 | 6/1968 | Bühler | 175/104 |

*Primary Examiner*—Stephen J. Novosad
*Assistant Examiner*—William P. Neuder
*Attorney, Agent, or Firm*—Head, Johnson & Stevenson

[57] ABSTRACT

A well bore casing inserting and drilling method and apparatus comprising the simultaneous drilling and casing setting of an oil and/or gas well bore by supporting a drill bit and actuating motor therefor from the lower end of the well casing whereby the well casing is lowered into the well bore simultaneously with the penetration of the earth by the drill bit assembly, the motor and drill bit being releasably secured within a housing whereby the motor and drill bit may be retrieved through the internal bore of the casing for repair or replacement of the drill bit or other operational components of the apparatus.

9 Claims, 5 Drawing Figures

WELL CASING INSERTING AND WELL BORE DRILLING METHOD AND MEANS

BACKGROUND OF THE INVENTION

1. Field of the Invention

This invention relates to improvements in well bore drilling operations and more particularly, but not way of limitation to a method and means for simultaneously inserting well casing into and drilling a well bore.

2. Description of the Prior Art

In the present day drilling of an oil and/or gas well bore it is the usual practice to suspend a string of drill pipe from a supporting structure, commonly called a derrick, and connect a drill bit to the lower end of the pipe. The drill pipe is rotated about its own axis by surface equipment commonly known as a kelly, and the rotation of the drill string is transmitted to the drill bit. As the drill bit cuts through or penetrates the earth, the well bore is formed and the weight of the drill string on the bit facilitates the penetration of the bit into the earth for deepening of the well bore. As the depth of the well exceeds the overall lenght of the drill string, it is necessary to add sections of drill pipe to the drill pipe string in order to assure that the drill bit will remain disposed against the bottom of the well bore during the drilling operation. Of course, in the event the drill bit becomes worn or otherwise damaged, it is necessary to elevate the entire drill string within the well bore in order to raise the drill bit to the surface of the ground for repair or replacement. This operation requires considerable time and expensive equipment since the drill string is usually several thousand feet long and quite heavy.

Subsequent to the penetration of the earth by the drill bit through a sufficient depth to drill the well bore to the desired well completion depth, it is necessary to remove the drill string and drill bit from the well bore and lower a string of well casing into the well bore for lining thereof and for receiving the production tubing therethrough. The pulling of the drill string as well as the lowering of the well casing is another time consuming and difficult task, requiring expensive labor and equipment to accomplish.

Another problem encountered in the usual present day well bore drilling method and means is establishment of communication between the surface of the ground and the bottom of the well bore in order to determine certain conditions existing at the bottom of the bore which may be relevant to the overall drilling operation. The most advanced method in use today for determining the conditions within the bore, particularly at the bottom of the bore is a slow, non-continuous, one-way communication system comprising a mud pulse telemetry. This involves the application of a pulse in the drilling mud, or the like, at the bottom of the well bore in order that the pulse may be transmitted upwardly through or by the mud. It will be apparent that some of the pulse is absorbed by the mud, resulting in relatively inaccurate and inefficient returns at the surface of the well.

SUMMARY OF THE INVENTION

The present invention contemplates a novel well bore drilling and well casing system and means wherein the well bore is cased simultaneously with the drilling of the bore without the use of a drill string and the attendant or auxiliary equipment normally used therewith. A retractable bit of the type known as a "drilling hole opener" and readily available at the marketplace, is operably connected with a downhole motor of any suitable or well known type, and the motor is secured or attached to a movable casing string. As the drill bit engages the earth for penetrating the earth during the drilling operation, the well casing moves concurrently or simultaneously downward through the bore therewith. When the drill bit becomes worn or damaged, the motor and bit carried thereby may be released from engagement with the well casing and elevated through the well casing to the surface of the ground by means of a cable and winch means operable from the surface. The well casing remains in position within the bore hole during the releasing or tripping operation of the motor and bit therefrom. The drill bit may then be repaired or replaced, and the motor and drill bit may be lowered through the well casing by the cable and winch means and reconnected at the bottom of the well casing for continuing the drilling operation.

Since the well casing is installed within the well bore as the bore is being drilled, a flat wire, closed loop, electrical communication and control system of any well known type may be installed in or secured on the wall of the casing. This provides a closed loop system between the surface of the well and the bottom of the well bore which permits the development and use of a down hole sensing means and system for guidance of the bit since the system may be monitored and controlled from the surface of the ground on a real time, continuous basis.

It is estimated that the complete elimination of the drill string and its associated surface equipment and labor required for the operation thereof will reduce the cost of well bore drilling operations by approximately ten to fifteen percent, which is significant when the overall cost of drilling the usual oil and/or gas well is considered. The development and the use of a closed loop electrical control system for establishing downhole communication may provide an even further cost saving in the drilling of well bores. The novel method and means of setting well casing simultaneously with the drilling of a well bore is simple and efficient in operation and economical and durable in construction.

DETAILED DESCRIPTION OF THE PREFERRED EMBODIMENT

Figure 1:
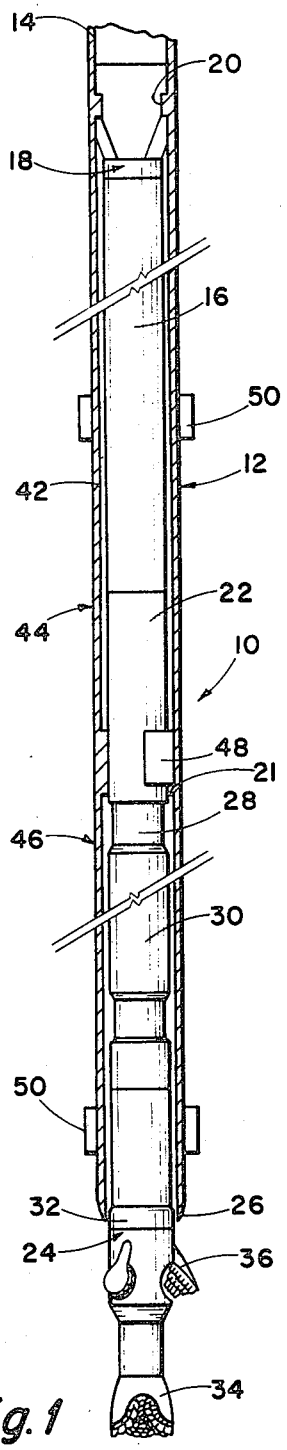
FIG. 1 is an elevational view of a well casing inserting and well bore drilling apparatus embodying the invention, with portions shown in section for purposes of illustration.
Figure 3:
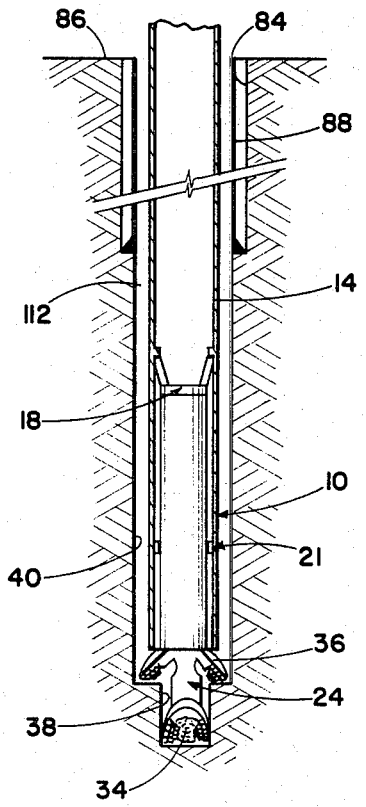
FIG. 3 is a sectional elevational view of a well casing inserting and well bore drilling apparatus embodying the invention in use for the drilling of a well bore.

Referring to the drawings in detail, and particularly FIGS. 1 and 3, reference character 10 generally indicates a well casing inserting or lowering and well bore drilling apparatus or control sub comprising a housing or tube 12 adapted to be secured to the lower end of a suitable well bore casing 14 in any suitable manner (not shown) for encasing or housing and supporting a down hole motor 16. There are many types of downhole motors available today, and the motor 16 may be of any suitable "off-the-shelf" type readily available at the marketplace. The motor 16 may be removably secured to or locked within the housing 12 in any suitable well known manner, such as by a motor lock assembly generally indicated at 18 and which may cooperate with longitudinally spaced inwardly directed annular shoulders or flange means 20 and 21 provided on the inner periphery of the housing 12. The motor 16 is preferably suspended or supported concentrically within the housing 12.

A transmission assembly 22 of any suitable or well known type may be operably connected to the lower end of the motor and transmits operational power from the motor 16 to a suitable drill bit 24 suspended therebelow and extending beyond the open lower end 26 of the housing or tube 12. It is preferably to interpose a saver sub assembly 28 and shock sub assembly 30 between the transmission 22 and bit assembly 24 for increasing the overall operating efficiency of the apparatus 10. Similarly, it is preferably to provide a suitable wear sleeve means 32 on the bit assembly 24 for protection thereof during a well bore drilling operation with the assembly 10.

The drill bit assembly 24 may be of any well known retractable type commonly known in the industry as a rock drilling hole opener, and usually comprises rotary or roller bit drill means 34 at the extreme outer or lower end thereof and a plurality of circumferentially spaced bits or cutters 36 spaced thereabove but is not limited thereto. In this manner, a well bore may be initially opened by the roller or rotary bit 34, as shown at 38 in FIG. 3, and enlarged to a diameter greater than the outer diameter of the housing 12 by the cutters 36, as shown at 40 in FIG. 3.

The housing 12 is preferably tubular, but not limited thereto, and is preferably of a longitudinally sectional construction including an upper pipe or motor lock tube section 42 secured in axial alignment with a torque tube means 44 and instrument probe means 46, all of which may be threadedly secured in tandem relation, or otherwise secured in longitudinally aligned relationship. In addition, it is desirable to provide a suitable torque pad means 48 cooperating between the torque tube means 44 and the transmission 22 or other appropriate part of the motor bit assembly so as to transmit the reactive torque of the drilling bit 24 to the housing 12 during a well bore casing lowering and drilling operation. It may also be preferable to provide a plurality of suitable circumferentially and longitudinally spaced reamers 50 on the outer periphery of the housing 12, as is well known, for facilitating the penetration of the well bore 40 by the housing 12 during the casing setting well bore drilling operation.

Figure 2:
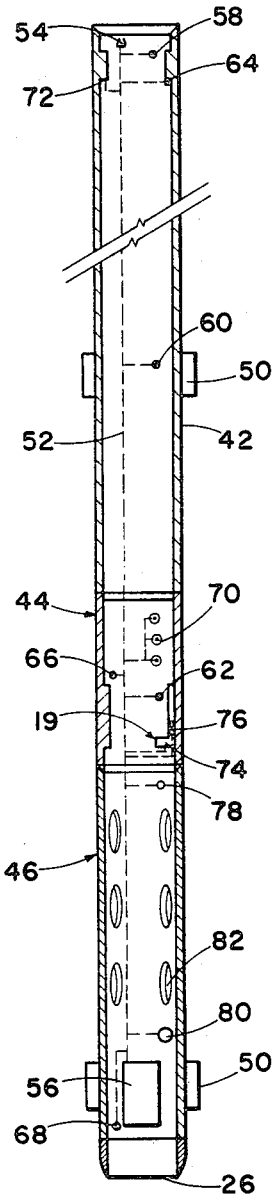
FIG. 2 is an elevational view of a control sub which may be utilized in the practice of the invention, with portions shown in section for purposes of illust- ration.

Referring now to FIG. 2, numerous control systems may be designed for control sub 10 depending upon the needs of the user. A typical system is schematically illustrated in FIG. 2. A suitable wire harness means 52 extends longitudinally through the sub 10, providing connection between a suitable harness electrical connector means 54 provided in the proximity of the upper end of the sub 10 and an electronic/nuclear sensor module 56 provided in the proximity of the lower end thereof. In addition, an upper position sensor means 58, a mid position sensor means 60 and a lower position sensor means 62 are disposed within the sub 10 and operably or electrically connected with the wiring harness 52 in any suitable or well known manner. A sensor means 64 is also operably connected with the wire harness means 52, and is preferably disposed in the proximity of the shoulder or flange 20 for sensing the weight on the bit 34 or assembly 24. An upper vibration and shock sensor means 66 and a lower vibration and shock means 68 are installed within the sub means 10 in any well known manner, and are operably connected with the wiring harness. A suitable transmission control means 70, preferably of a magnetic type, but not limited thereto, is operably connected with the wiring harness means 52 and the transmission 22 for controlled actuation thereof, as is well known. An upper motor lock sensor means 72 is operably connected with the wiring harness means 52 in the proximity of the locking means 18, and a lower motor lock sensor means 74 is operably connected with the wiring harness means 52 in the proximity of a lower motor locking means 19. In addition, a suitable torque sensor means 76 is operably connected with the wiring harness means 52 is disposed between the torque pad means 48 and the torque tube means 44.

A suitable RPM sensor means 78 and a gas sensor means 80 are preferably provided in the instrument probe means 46 and are operably connected with the wiring harness means 52. In addition, it is desirable to provide a plurality of circumferentially and longitudinally spaced mud flow ports 82 in the sidewall of the instrument probe means 46.

Referring now to FIG. 3, a simultaneous well bore casing inserting and drilling operation of the present invention may be accomplished in the following manner: The usual practice of initially opening the earth or drilling a relatively large diameter bore at the surface 86 of the earth and the installation and/or setting of the conductor casing and/or surface casing 88 therein may be performed in any well known manner. The normal purpose of setting the casing 88 is to protect the upper subsurface formations from contamination by the well fluids (not shown) which may ultimately be elevated to the surface 86 through the well bore 40. In this manner, ground water, and the like may be protected from contamination and the well bore may be stabilized for further operations.

Subsequent to the lowering or inserting of the casing 88, the sub means 10 carrying the retractable drilling hole opener or drill bit assembly 24 may be suspended in substantial axial alignment with the internal bore of the surface casing 88 and lowered therethrough in substantially concentric relation with respect thereto until the drilling hole opener 24 is brought into engagement with the bottom of the well bore. Of course, the upper end of the control sub assembly 10 is secured in any suitable or well known manner to the lower end of a well casing section 14, and the wiring harness means 52 may be electrically or operably connected with a source of electrical current, such as a signal and/or power cable which may extend longitudinally through or on the outer periphery of the casing section 14. This operably connects the wiring harness and electrical component operably connected therewith to the usual surface recording equipment (now shown) whereby a visual indication of the subsurface conditions may be constantly viewed.

When the drill bit assembly 24 has been positioned against or in contact with the bottom of the well bore 40, the motor 16 and transmission 22 may be activated for initiation of the operation of the drilling bit assembly 24. As the bit 34 penetrates the earth at the bottom 38 of the well bore, the side bits or cutters 36 engage the sidewalls of the bore above the bit 34 and increases the diameter of the bore as shown at 40. The bore 40 opened by the side bits or cutters 36 is preferably of a diameter greater than the outer diameter of the housing 12 and well casing 14 thus facilitating the downward movement of the housing 12 and casing 14 simultaneously with the downward penetration of the earth by the bit assembly 24. Of course, the reamers 50 function in the usual or well known manner for facilitating the downward movement of the housing 12 in the well bore, particularly in instances wherein the well bore does not extend vertically downwardly from the surface 86 of the earth, but veers at an angle with respect thereto.

In the event the bit 34 or cutters 36 become worn, or require repair or replacing for any reason, the locking means 18 and 19 may be released by remote actuation thereof from the surface of the well bore in any suitable or well known manner, and motor 16, transmission 22, subs 28 and 30 and drill bit assembly 24 may be pulled upwardly through the housing 12 and casing 14 by the usual cables (not shown) normally used in well bore drilling operations, and the like. Of course, as hereinbefore set forth, the drill bit assembly 24 is of a retractable type wherein the cutters 37 may be moved radially inwardly to preclude interference therefrom as the drill assembly is elevated to the surface of the ground. The drill assembly 24 may be removed from its connection with the motor 16 and associated elements, and repaired or replaced, as required, whereupon the bit assembly 24 may again be lowered into the bore 40 until the bit 34 is in engagement with the bottom of the bore, and the casing setting and drilling operation may be continued. Of course, as the depth of the well bore 40 increases, it may be necessary to add additional sections of casing 14 at the surface of the well, as is well known in the well drilling industry.

When the well bore has been drilled to the desired completion depth therefor, the motor 16, transmission 22, subs 28 and 30 and drill bit assembly 24 may be removed from the well bore as hereinbefore set forth, and the casing inserting operation may be completed in the usual manner for securing the casing efficiently within the well bore. The well bore has thus been drilled and the casing inserted therein in a simultaneous operation, and the cased well bore is ready for the usual installation of the production tubing, downhole pumping means and the like normally required for the production of oil and/or gas therefrom.

Figure 4:
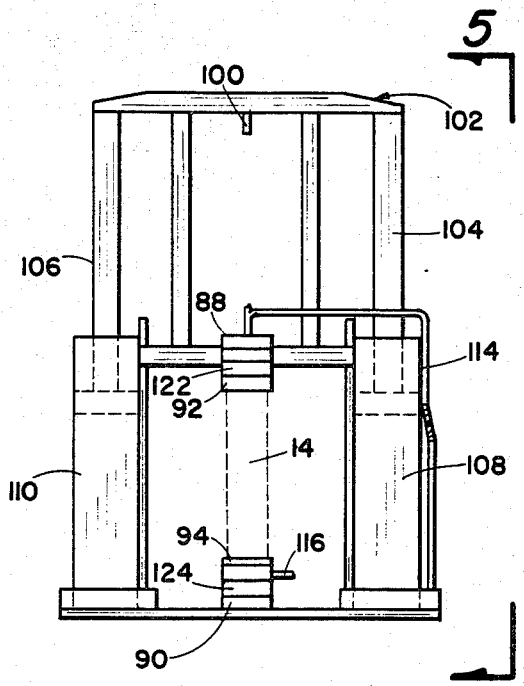
FIG. 4 is a front elevational view of surface equipment which may be utilized in combination with the well casing inserting and well bore drilling apparatus embodying the invention.
Figure 5:
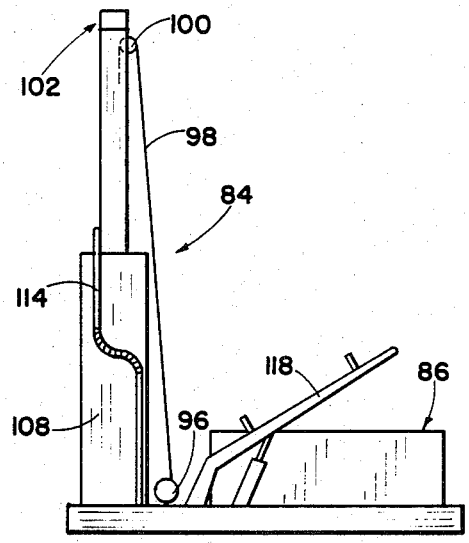
FIG. 5 is a view taken on line 5—5 of FIG. 4.

Referring now to FIGS. 4 and 5, reference character 84 generally indicates a typical arrangement for the surface equipment which may be utilized with the well bore casing inserting and drilling operation of the invention. Of course, as hereinbefore set forth, the usual drill string (not shown) and all of the equipment associated therewith is eliminated by the present well bore casing inserting and drilling method and means. A simple casing dispenser rack means 86 may be provided in lieu of the usual pipe racks normally in use in the present day well bore drilling operations. A suitable blow out preventor 88 may be provided in the proximity of the top of the casing in addition to a lower blow out preventor 90. Of course, suitable upper slip means 92 and lower slip means 94 are provided for receiving the casing 14 therethrough and supporting the casing in the usual or well known manner. A power swivel 122 and a simple and slow rotary mechanism or rotary drive means 124 may be used for transmitting rotation to the well casing 14.

A suitable winch means 96 may be provided at the surface of the well bore, and a bottom hole assembly retrieval line 98 may extend from the winch 96 over a pulley means 100, and downwardly through the well casing 14 for connection with the downhole motor bit assembly in any well known manner for facilitating the raising and lowering thereof as hereinbefore set forth, In addition, it may be desirable to support the pulley means 100 from a frame means 102 having the support members 104 and 106 thereof operably connected with or supported by hydraulic ram assemblies 108 and 110, respectively. The hydraulic ram assemblies 108 and 110 are used to lower the casing 14 into the well bore.

The drilling mud circulation system used during the well bore casing inserting and drilling operation is substantially the same as in present day drilling operations, with the drilling mud being circulated downwardly through the central bore of the casing 14 and housing 12 and upwardly through the annulus 112 (FIG. 3) between the outer periphery of the well casing 14 and bore 40. The usual stand pipe mud line 114 may be provided in communication with the drilling mud source or supply (not shown) and directs the mud into the upper portion of the casing through the power swivel 122 in the usual manner. A suitable return mud line 116 is also provided in communication with the annulus 112 for receiving the returning or recirculated mud supply and returning the mud to a mud pit or the like (not shown) as is well known.

With regard to the pipe or casing rack 86, it may be desirable to provide a transfer arm means generally indicated at 118 in FIG. 5 for facilitating the transfer of individual sections of casing from the rack 86 to a position for connection with the uppermost casing section as the length of the casing string must be increased during the well drilling and casing setting operation.

By way of summary, the main components of the well bore casing and drilling system of the present invention include the casing string 14 having the control sub 10 secured to the lowermost end thereof, the control sub comprising a motor 16, transmission 22, shock sub 30 and retractable bit assembly 24. The casing string 14 is preferably a standard API casing modified to incorporate flat wire electric cables (not shown) covered by a protective coating, and operably connectable with the wire harness 52 of the control sub.

The motor 16 is a standard, off-the-shelf motor; the transmission 22 is preferably a speed reducing unit that is controlled from the surface 86 and permits a speed control similar to that in an automobile in the sense that gear ratios may be changed. This permits the selection of different speeds and torques during the drilling operation, depending upon the type of subsurface formation being penetrated by the bit assembly 24. The shock sub may be a standard, off-the-shelf item incorporated into the power system of the apparatus 10 to protect the motor and transmission from shock and vibration loads, and to permit a better overall system control. The retractable bit assembly 24 may also be an off-the-shelf item, which may be modified, if desired, to incorporate mud jet components (not shown) around the cutting elements 36, for facilitating the efficient operation of the bit assembly 24.

As hereinbefore set forth, the flow of the mud stream is downwardly through the internal bore of the casing 14 and housing 12, and up the annulus 112 between the casing and well bore. The down hole equipment may be lowered into operating position by the wire line or cable 98 which incorporates an integral power cable for powering or supplying power to a downhole electric motor (not shown). Thus, all of the downhole equipment may be electrically powered and controlled. The novel assembly of elements permits the use of a downhole, closed loop, electrical system which will provide a real time communication in both the downward and upward directions in the bore hole, thus providing a more efficient determination of the downhole conditions than is presently available with the normal mud pulse systems.

From the foregoing, it will be apparent that the present invention provides a method and means of inserting well bore casing simultaneously with the drilling of the well bore, thus eliminating the necessity for a drill string and the associated equipment required for the use thereof. The novel casing inserting and well bore drilling method and means permits the completion of a well bore with considerably less expense and time involvment than with present day method and apparatus.

Whereas the present invention has been described in particular relation to the drawings attached hereto, it should be understood that other and further modifications, apart from those shown or suggested herein may be made within the spirit and scope of this invention.

What is claimed is:

1. An apparatus for simultaneously inserting a well bore casing and drilling a well bore, comprising:

a control sub means operably connected to the lowermost end of the well bore casing;

motor means suspended within the control sub;

a drilling bit means operably connected with the motor means;

releasable locking means cooperating between the motor means and the control sub means for selective releasing of the motor means and drilling bit means through the well casing; and power means operably connecting the motor means with the surface of the well bore for controlled operation thereof.

2. An apparatus as set forth in claim 1 wherein said drilling bit means is a retractable drilling hole opening means.

3. An apparatus as set forth in claim 1 and including transmission means disposed within the control sub and operably connected with the motor means.

4. An apparatus as set forth in claim 1 wherein the motor means is a down hole motor.

5. An apparatus as set forth in claim 1 and including a reactive torque absorption means for transferring torque to the well casing.

6. An apparatus as set forth in claim 5 wherein said reactive torque absorption means includes a torque transfer means for transferring any reactive torque present in the apparatus during the drilling of the well bore to the casing.

7. A method of drilling a well bore and simultaneously inserting well casing therein, comprising:

initially opening the earth to provide a bore therein;

positioning a well bore casing in the opening in the earth, the casing having a control sub on the lower end thereof;

positioning a motor driven drill bit means within the control sub;

releasably locking the motor driven drill bit means to the control sub;

selectably releasing the motor driven drill bit means from the control sub for retrieval of the motor driven drill bit means through the well bore casing;

actuating the drill bit means for deepening the bore and simultaneously moving the housing and casing downwardly in the bore until the desired well bore competion depth is achieved.

8. A method of drilling a well bore and simultaneously inserting well casing therein as set forth in claim 7 including the step of circulating a drilling mud downwardly through the casing and housing to the bottom of the bore and recirculating the mud upwardly through the annulus between the well casing and the bore.

9. A method of drilling a well bore and simultaneously inserting well casing therein as set forth in claim 7 including the step of providing electrical communication between the surface of the well bore the bottom of the bore through a closed loop electrical system.

* * * * *